US007348504B2

(12) United States Patent
Brojanac

(10) Patent No.: US 7,348,504 B2
(45) Date of Patent: Mar. 25, 2008

(54) MOUNTABLE LOCKOUT DEVICE

(75) Inventor: Michael Brojanac, Jackson, WI (US)

(73) Assignee: Master Lock Company LLC, Oak Creek, WI (US)

( * ) Notice: Subject to any disclaimer, the term of this patent is extended or adjusted under 35 U.S.C. 154(b) by 22 days.

(21) Appl. No.: 11/443,966

(22) Filed: May 30, 2006

(65) Prior Publication Data

US 2006/0278504 A1 Dec. 14, 2006

Related U.S. Application Data

(60) Provisional application No. 60/685,746, filed on May 27, 2005.

(51) Int. Cl.
*H01H 9/00* (2006.01)

(52) U.S. Cl. ..... 200/43.22; 200/333; 200/334

(58) Field of Classification Search ..... 200/43.01, 200/43.11, 43.14–43.16, 43.19, 43.21, 43.22, 200/333, 334
See application file for complete search history.

(56) References Cited

U.S. PATENT DOCUMENTS 3,974,346 A * 8/1976 Keprda ..... 200/5 B
4,394,552 A * 7/1983 Schlosser ..... 200/61.62
4,638,129 A * 1/1987 Partus et al. ..... 200/43.22
5,157,577 A * 10/1992 Balaud et al. ..... 361/724
5,260,528 A 11/1993 Benda
5,324,897 A 6/1994 Melgoza et al.
5,468,925 A 11/1995 Mohsen
5,543,593 A 8/1996 Turek
5,558,209 A * 9/1996 Mohsen ..... 200/43.22
5,831,813 A * 11/1998 Gomez ..... 361/622
5,936,214 A * 8/1999 Phillips ..... 200/43.22

* cited by examiner

*Primary Examiner*—Michael A Friedhofer
(74) *Attorney, Agent, or Firm*—Calfee, Halter & Griswold LLP

(57) ABSTRACT

A lockout device is provided for an operable instrument mounted to a structure with a first set of fasteners. The lockout device includes a base member having first and second side walls, an opening disposed between the side walls, a lock tab, and at least one mounting plate removably attached to the first and second side walls. The opening receives the instrument when the base member is mounted to the structure. The lock tab includes an aperture for receiving a locking member. The mounting plate includes a mounting feature for receiving a portion of one of the first set of fasteners to mount the base member to the structure. The lockout device further includes a cover member attachable to the base member and movable between a lockout position and an open position. The cover member includes an outer portion for covering the instrument when the base member is mounted to the structure and the cover member is in the lockout position.

34 Claims, 6 Drawing Sheets

MOUNTABLE LOCKOUT DEVICE

CROSS-REFERENCE TO RELATED APPLICATIONS

This non-provisional application claims the benefit of U.S. Provisional Patent Application No. 60/685,746, entitled "Switch Lockout Device," filed May 27, 2005, which is hereby incorporated in its entirety.

FIELD OF THE INVENTION

The present invention relates to mountable lockout covers for preventing unauthorized or accidental operation of an operable instrument. Exemplary applications include lockout devices for manually operable instruments, such as electrical switches, including, for example, toggle and paddle or rocker style wall mounted electrical switches.

BACKGROUND OF THE INVENTION

Many switches, such as, for example, toggle and rocker type wall-mounted electrical switches, are designed to be turned from an "on" position to an "off" position with minimal force. In fact, the switches are designed to offer little resistance to position change. In application, this feature makes switches easy to use and operate. However, in some conditions, the low resistance of switches to position change can create several concerns. Accidental, innocent or unauthorized switch position changes can cause safety hazards, damage equipment or cause lost production time and/or in-process material losses. In some circumstances, other operable instruments, such as, for example, control knobs or dials, push buttons electronic sensors, or electrical outlets, may also require a secure lockout condition to prevent accidental or unauthorized use.

Safety lockout devices are known in the art to prevent switch position changes. Conventional devices cover the switch and prevent someone from moving the switch under normal operating conditions. However, known devices have several undesirable features that limit their ease of use, applicability, and effectiveness. Many devices are useable exclusively with either a rocker switch or a toggle switch, but not both. Some devices exceed the boundaries of smaller residential face plate sizes. Still other devices are not adaptable to be use in a "locked on" or "locked off" position without removing and reinstalling the device. Further, conventional devices are known to include an opaque cover that prevents an operator from ascertaining the switch position without removing the cover.

SUMMARY OF THE INVENTION

The present invention relates to a lockout device for an operable instrument, such as, for example, an electrical switch, control dial, electronic sensor, push button, or electrical outlet, that is mounted to a structure, such as a wall or panel. By attaching a lockout device to the structure to which the instrument is mounted, access to the instrument may be prevented when the lockout device is in a locked condition. In one embodiment, the lockout device may be mounted to the structure using an existing fastener arrangement associated with the instrument, such as the fasteners and mounting holes used to mount the instrument to the structure. In one embodiment, the lockout device may be adapted to be assembled with a face plate for an electrical switch to prevent unauthorized or accidental actuation of the switch during a lockout.

In another embodiment, a lockout device is provided for an operable instrument mounted to a structure with a first set of fasteners. The lockout device includes a base member having first and second side walls, an opening disposed between the side walls, a lock tab, and at least one mounting plate removably attached to the first and second side walls. The opening receives the instrument when the base member is mounted to the structure. The lock tab includes an aperture for receiving a locking member. The mounting plate includes a mounting feature for receiving a portion of one of the first set of fasteners to mount the base member to the structure. The lockout device further includes a cover member attachable to the base member and movable between a lockout position and an open position. The cover member includes an outer portion for covering the operable instrument when the base member is mounted to the structure and the cover member is in the lockout position.

Other aspects of the present invention include additional features that may be provided separately or in combination. As an example, one or more mounting slots may be provided extending from a side wall of a base member for receiving a portion of a face plate fastener. As another example, a lockout device base member may be provided with a first set of mounting features for receiving a first set of fasteners used with a first type of electrical switch, and with a second set of mounting features for receiving a second set of fasteners used with a second type of electrical switch.

Further features and advantages of the invention will become apparent from the following detailed description made with reference to the accompanying drawings.

DETAILED DESCRIPTION OF THE INVENTION

The Detailed Description of the Invention merely describes preferred embodiments of the invention and is not intended to limit the scope of the claims in any way. Indeed, the invention as described by the claims is broader than and unlimited by the preferred embodiments, and the terms in the claims have their full ordinary meaning.

The present invention provides a mountable lockout device, for preventing access to or operation of an operable instrument, such as, for example, a control dial, push button, electronic sensor, electrical outlet, or electrical switch. In one embodiment, the lockout device may be adapted to assemble to a face plate of an electrical switch to prevent access to the electrical switch when the device is in a locked or lockout condition. The device may be provided with one or more of the novel design features disclosed herein to provide improved adaptability, security, safety and/or convenience. For example, a device according to the present invention may be adapted for assembly with different types of operable instruments, such as, for example, different types of electrical switches. As one such example, a lockout device according to the present invention may be adaptable for assembly with both toggle-type electrical switches and rocker-type electrical switches. As another example, the device may be adapted to lock over a switch in multiple switching positions without removal of the device from the face plate. As yet another example, the device may be adapted to assemble to the face plate without removal of the screws from the face plate.

FIGS. 1-8 illustrate a lockout device 10 according to an exemplary embodiment of the invention. While the figures illustrate the use of the exemplary lockout device with toggle and rocker-type electrical switches, any one or more of the features of the exemplary embodiments may be used with lockout devices for different types of operable instruments, such as, for example, control dials, push buttons, electronic sensors, and electrical outlets, or with lockout devices for different types of electrical switches, including, for example, dimmer switches, three way switches, rotary switches, knife switches, and keyed switches. The device is beneficial for many applications where a control instrument must be locked, such as, for example, in applications where maintenance personnel are servicing factory equipment, where a switch or outlet is known to be faulty, or where a control setting must not be altered. As one example, the device can be used to lock an electrical switch in one position, such as, for example, in an off or an on position, by use of a conventional locking type device or locking member, Such as, for example, a padlock, hasp, cable or similar object. Applications may include permanent and temporary lockouts. The devices are durable under normal use and can be used indefinitely.

Figure 3:
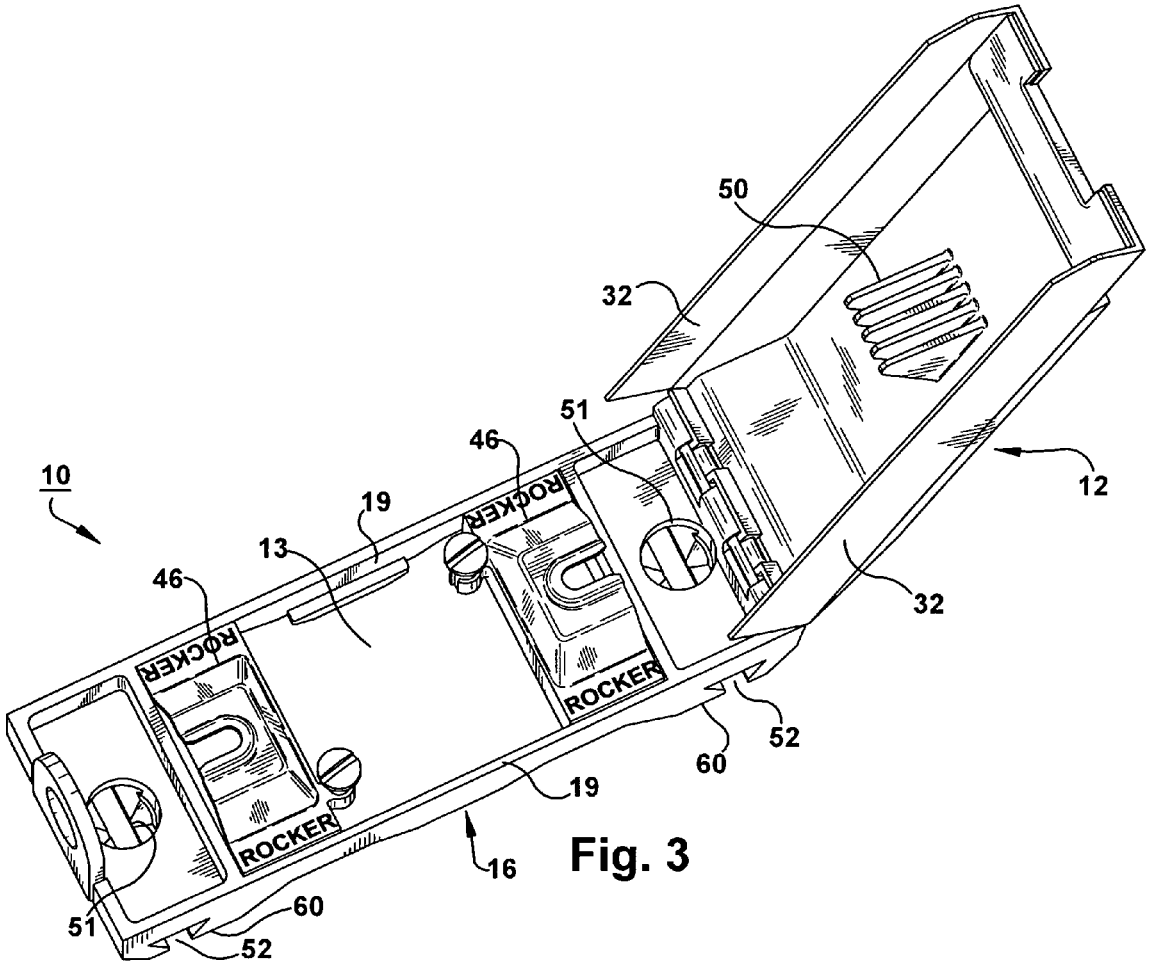
FIG. 3 is a perspective view of a lockout device shown in an open position with mounting plates installed in a first orientation to accommodate a rocker-type electrical switch.
Figure 4:
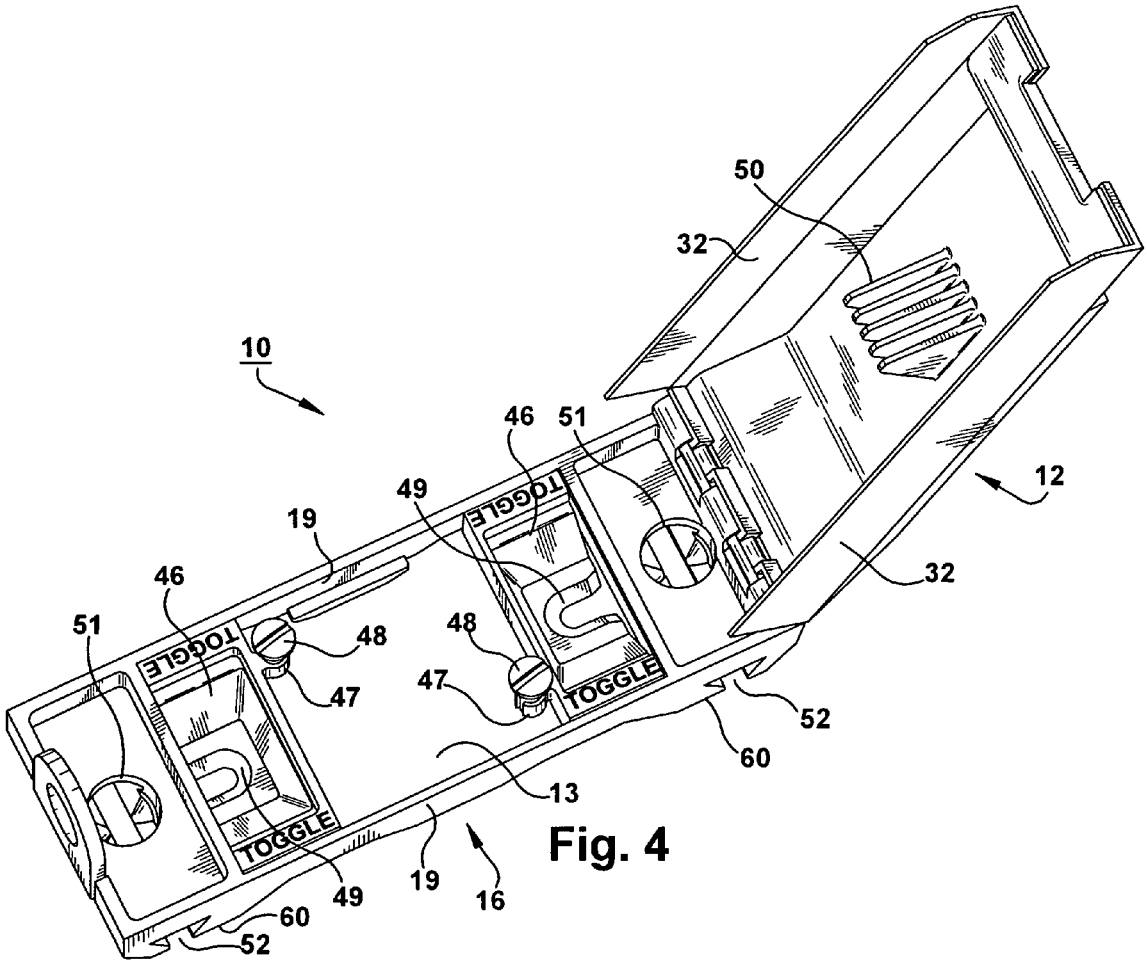
FIG. 4 is a perspective view of the device of FIG. 3, shown in an open position with mounting plates installed in a second orientation to accommodate a toggle-type electrical switch.

The device 10 of the illustrated embodiment includes a lockout cover or cover member 12 and a lockout base or base member 16. According to the present invention, the cover member 12 and base member 16 may be attached or attachable to each other in one of may different ways, such as, for example, interlocking slots and tabs, fasteners, or a flexible web between base and cover member portions of a one-piece design. Another embodiment of the present invention may rely oil the installation of a padlock or other locking member to secure the separate cover member 12 to the base member 16. In the illustrated embodiment, the cover member 12 is hinge-ably mounted to the base member 16 at a top end 18 of the base, such that the cover member 12 may pivot with respect to the base member 16, between an open position and a closed or lockout position. The cover member 12 may be provided with a lip 20 that extends beyond the bottom end of the base 16, allowing an operator to grasp or press the lip 20 to manually lift and pivot the cover 12 in relation to the base member 16. The cover member 12 further includes an outer portion 17 which covers an opening 13 in the base member 16 in the lockout position. The opening 13 is shown in FIGS. 3 and 4. The opening 13 may be sized to receive one or more types of operable instruments, such as electrical switches. The instrument is accepted or protrudes through opening 13 when the device 10 is used. Thus, locking closure of the cover member will selectively restrict access to the instrument that protrudes through opening 13 into the device 10. The cover member 12 allows access to the instrument when the cover member 12 is opened. While the illustrated embodiment restricts access to an electrical switch to prevent manual operation of the switch, the cover member 12 may also restrict other types of access to an instrument, such as, for example, access to an electronic sensor by a remote control device. The outer portion 17 may be provided with a flat center portion 22, upon which labels containing warnings, safety instructions or other indicia may be placed.

The base member 16 of the illustrated embodiment also includes a protruding shackle tab or lock tab 26 that defines an aperture 28, such as a hole or slot. A locking type device or portion thereof, such as for example, a padlock shackle, can be placed through this aperture 28 to block movement of the cover member 12 from the lockout position to the open position. While the lock tab 26 of the illustrated embodiment extends outward from the bottom end of the base member 16, extending past a cut-out in the bottom end of the cover member 12, it should be noted that the lock tab 26 may be provided on many different surfaces and locations of the base member 16 to extend past many different portions of the cover member 12, such that the inserted locking member will block movement of the cover member 12 from the lockout position. Further, the lock tab 26 need not be integral to the base member 16, as it may be attached to the base member in some other fashion.

Figure 2:
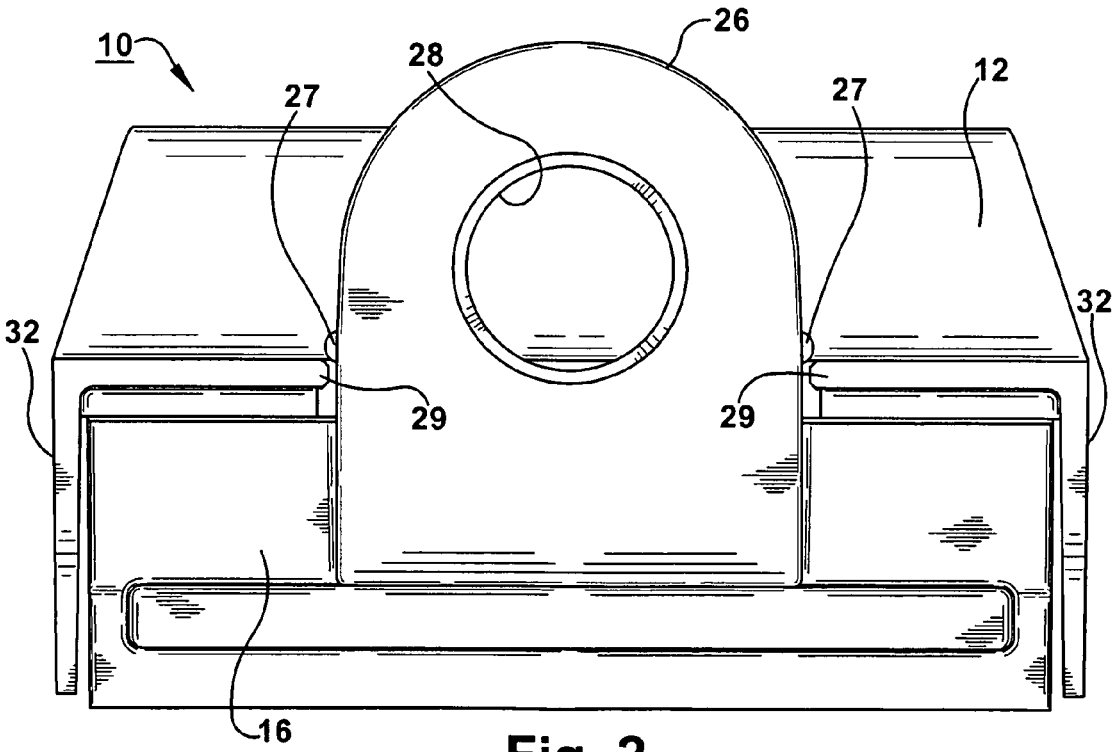
FIG. 2 is a bottom view of the device of FIG. 1, as mounted in one exemplary orientation.

FIG. 2 is a bottom view of the lockout device 10 showing the tab 26 and aperture 28 of the illustrated embodiment in greater detail. As shown, the tab 26 may be provided with a small knob or detent 27 on one or both sides to provide a snap fit between the lock tab 26 and the mating edge 29 of the cover member 12, preventing the cover member 12 from opening inadvertently prior to the user installing a locking type device through the tab aperture 28. In other embodiments, similar detents may be provided on other mating surfaces of the cover member 12 or base member 16 to provide a snap fit engagement during closure.

Figure 1:
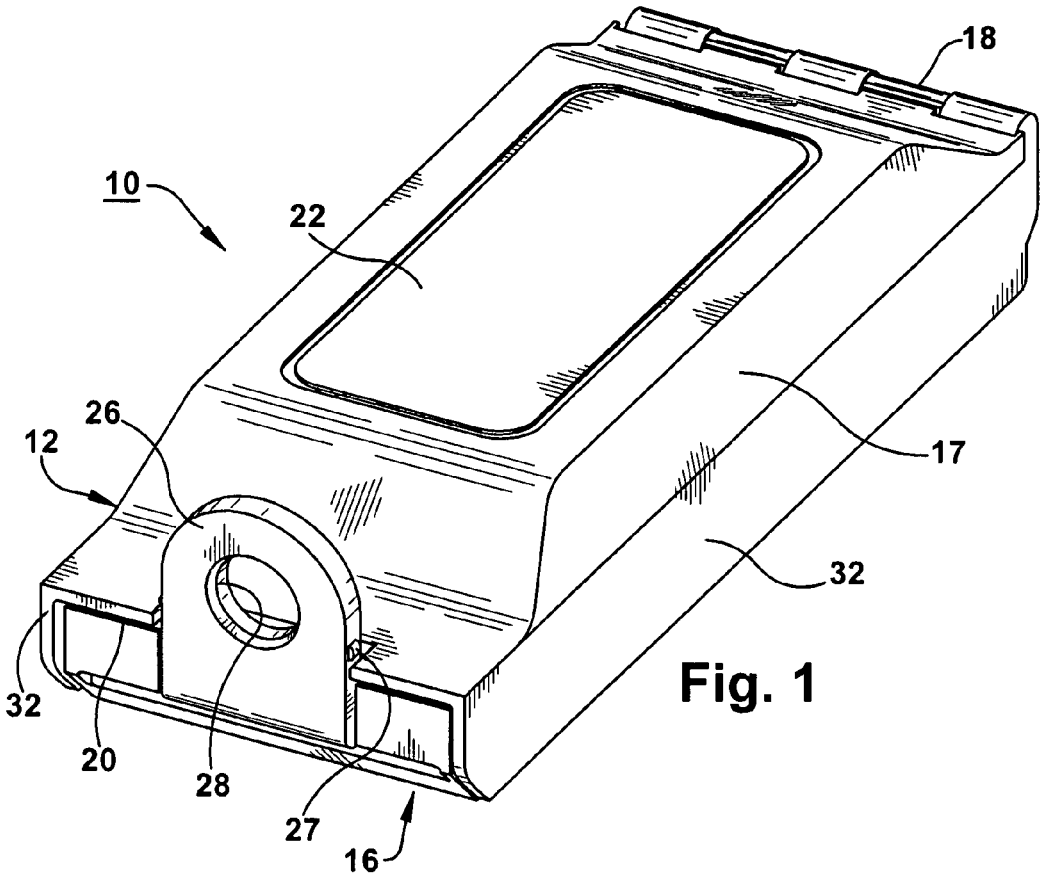
FIG. 1 is a perspective view of a lockout device shown in a closed or lockout position.

As shown in FIGS. 1 and 2, when the cover member 12 is in a closed or lockout position, the base member 16 may nest between extending side walls 32 of the exemplary cover 12. The side walls 32 may, but need not, extend over the side walls 19 of the base member 16 to minimize access to the base member 16 in the lockout position.

According to the present invention, the lockout device may be adapted for assembly with a wall or other structure on which an operable instrument is mounted. While the device may be assembled over the operable instrument with fasteners and mounting holes provided specifically for installation of the lockout device, in one embodiment of the invention, the lockout device may be mounted to the wall or other structure by using the instrument's existing face plate or similar mounting base and corresponding fasteners and mounting holes, as commonly used with many different types of operable instruments, such as electrical switches, including, for example, toggle-type and rocker-type switches. To assemble the base member of the device with a face plate of one or more types of electrical switches, the base member may be provided with one or more sets of mounting features sized and dimensioned to align with the installed fastener or fasteners of a corresponding face plate. While the illustrated embodiment shows a set of two mounting features provided to engage a set of two face plate screws, a different number of mounting features may be provided for engagement with a different number of fasteners, and, in some applications, it may not be necessary to provide enough mounting features to accommodate all of the fasteners. By providing multiple sets of mounting features on the base member, the device may be adapted to be used with different types of operable instruments, such as electrical switches, having different types or configurations of mounting fasteners.

Figure 5:
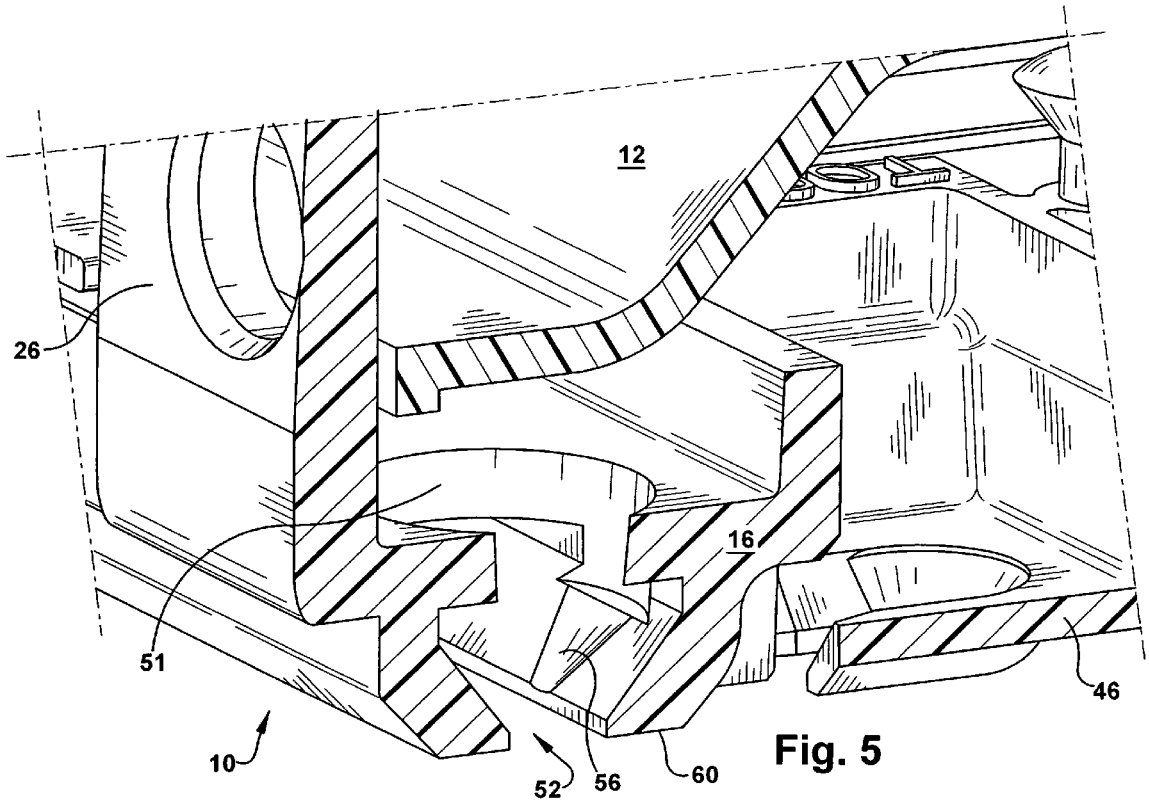
FIG. 5 is a partial cross-sectional perspective view of the device of FIG. 4.

The mounting features of the present invention may include one or more of many different types of slots, holes, grooves or recesses, wherein the corresponding face plate fastener, such as a screw, may be loosened or removed from the face plate, received in or inserted through the mounting feature, and retightened to mount or affix the base member to the face plate. In the illustrated embodiment, as shown in FIGS. 3, 4 and 5, one set of mounting features includes mounting slots 52 extending across a rear surface 60 of the base member 16. The slots 52 may open to one or both sides of the base member 16 such that a head portion of a face plate fastener or screw may be received into the slot 52 without removing the screws from the face plate. The rear surface 60 may be dimensioned to align flush with the front surface of the face plate to which the base member 16 is to be assembled. The side walls 32 of the cover member 12 may effectively prevent access to the slot 52 when the cover member 12 is in the lockout position. The base member 16 may further be provided with an access hole 51 in a front portion of the base member 16 that intersects the mounting slot 52, to allow access to the fastener in the slot 52 with a screwdriver or other tool. One advantage of a slot-type mounting feature such as the mounting slots 52 of the illustrated embodiments is that the fastener may be loosened, received in the slot 52 and tightened to mount or affix the base member 16 to the face plate without removing the fastener from the face plate.

Figure 7:
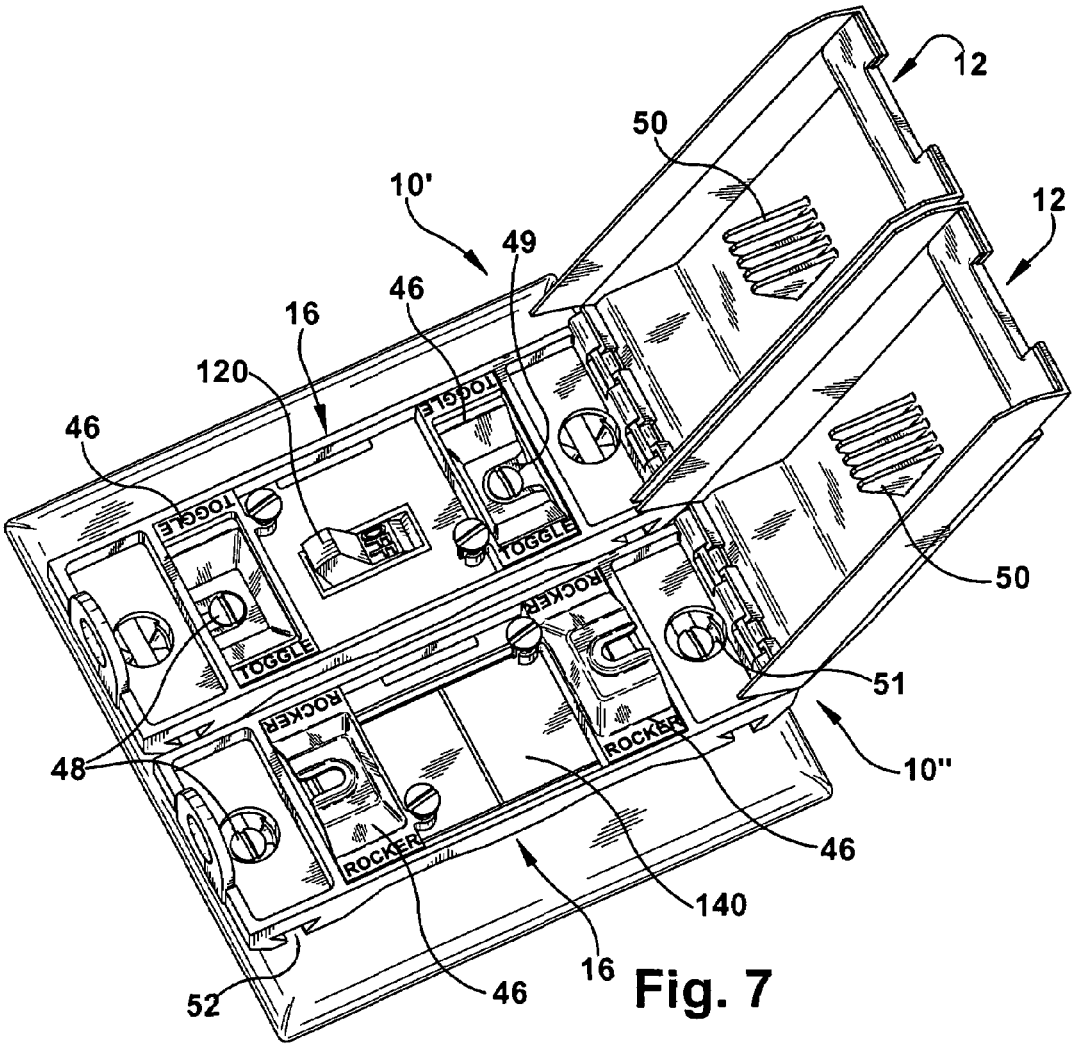
FIG. 7 is a perspective view of a dual electrical switch face plate and switch assembly with lockout devices assembled to both switches.

Further, the mounting slot or slots 52 may be dovetailed to stabilize and center the head of the fastener within the slot 52 during installation. Also, as shown in FIG. 5, the back of the portion of the slot 52 at which the fastener is to be mounted, such as the portion aligned with the access hole 51, may include a countersink 56 to further stabilize and secure the fastener and the base member 16 to the face plate upon tightening. This structure acts as a self-centering mechanism when the screws are tightened down such that the screw head will seat itself into the recessed countersink cavity 56. By becoming fully seated, the device is locked into place and cannot be removed by sliding the device in a direction parallel with the face plate. While the mounting slot or slots 52 may be provided at any dimension or orientation for assembly with fasteners of many types of electrical switch face plates, the mounting slots 52 of the illustrated embodiment are positioned to align with the mounting screws of a standard rocker-type electrical switch, as shown in the assembly of FIG. 7.

According to another aspect of the invention, one or more sets of mounting features may be provided on one or more mounting plates removably attachable to the base member. By providing different mounting features on opposite sides of removable mounting plates or on separate removable mounting plates, the device may be adapted to mount to many different types of operable instruments, such as electrical switches and corresponding face plates. Further, the mounting plates may include contours or cut-outs specifically adapted to accommodate the shape or dimensions of the electrical switch with which the mounting plate is to be used. In the illustrated embodiment shown in FIGS. 3 and 4, mounting plates 46 are attached to the side walls 19 of the base member 16, defining ends of the base member opening 13 between the side walls 19.

Figure 6:
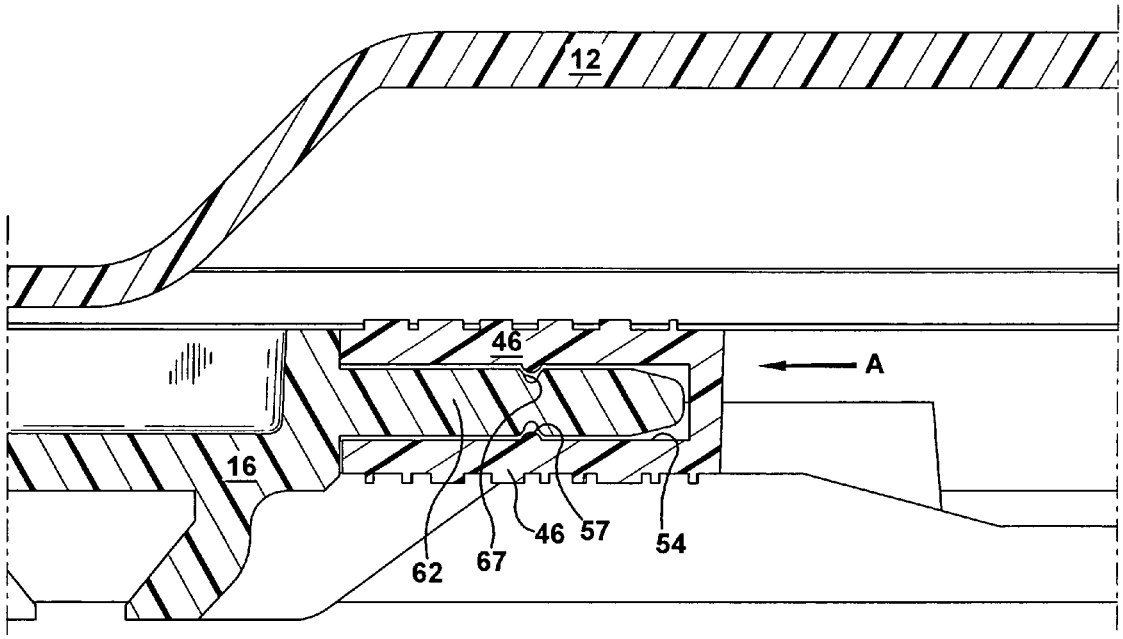
FIG. 6 is a partial cross-sectional side view of the device of FIG. 4.

The mounting plate or plates may be attached to the base member in many different ways, including, for example, with fasteners, interlocking slots and tabs, or adhesives. In the illustrated embodiment shown in the cross-sectional view of FIG. 6, the mounting plates 46 include side slots 54 that engage corresponding side rails 62 on the base member for sliding installation of the mounting plate 46 in the base member opening 13. Additionally, either or both sides of the slots 54 and rails 62 may include corresponding detents 57 and grooves 67 to provide a secure, snap-fit engagement between the base member 16 and the mounting plate 46. As illustrated in FIG. 6, an operator can press fit the mounting plate or slide 46 in a direction A. The distal edge of the side rail 62 may be chamfered to facilitate entry into and centering within the mounting plate 46 during installation. This press-fit connection is adequate to prevent mounting plate movement after installation and during normal use. To convert the device for use with another type of switch, an operator can disengage the mounting plate 46 with the application of firm manual force to the mounting plate 46 in a direction opposite A.

In the illustrated embodiment, the base member 16 is provided with two mounting plates 46 including mounting features for assembly with a standard toggle-type electrical switch when the mounting plates 46 are installed in a first orientation, as shown in FIG. 4. The exemplary toggle switch mounting features include countersunk slots 49 dimensioned to receive the screws of a toggle switch face plate. The exemplary slots 49 are disposed on contoured surfaces that align the slots 49 with the back surface 60 of the base member 16 to facilitate secure mounting of the base member 16 to the toggle switch face plate. The assembly of a lockout device to a toggle switch according to this exemplary embodiment is illustrated in FIG. 7. In the illustrated embodiment, the mounting plates 46 may be removed or installed in an inverted or second orientation, also shown in FIG. 7, to accommodate the larger dimensions of another switch, such as the rocker-type switch, for which mounting features 52 are provided on the body of the base member 16 itself. The mounting plates 46 of the illustrated embodiment, when assembled in the inverted orientation for assembly with a rocker-type switch, provide additional protective cover for the endmost portions of the rocker switch. In another embodiment of the invention, substitute mounting plates (not shown) may be provided with mounting features having different sizes or dimensions to accommodate different operable instruments, such as electrical switches, face plates, or fasteners. As illustrated in FIGS. 3, 4 and 7, the mounting plates 46 may be embossed, engraved or otherwise marked to identify the proper mounting plate and plate orientation to accommodate the type of instrument to which the lockout device 10 is to be assembled.

As insertion of the face plate fasteners through the mounting features of the base member and into the face plate may require a longer than standard fastener, ready access to one or more spare fasteners, such as extra-long fasteners, may be desired during installation of the lockout device. In other embodiments, the availability of tamper resistant fasteners may be desired as an added safeguard against tampering with the lockout device. As such, one or more retaining fingers may be provided on the base member, cover member, or mounting plate to retain one or more spare fasteners that may be used to affix the base member to the corresponding face plate. The same retaining fingers may also be used to retain the original face plate fasteners while the lockout device is installed. In the illustrated embodiment, as shown in FIGS. 3, 4 and 7, the mounting plates 46 are provided with semicircular retaining fingers 47 that retain face plate screws 48 in a snap fit engagement; however, it should be noted that different types of retaining fingers may be used on different locations of the mounting plates, the base member, and/or the cover member.

According to the present invention, the inner surface of the outer portion of the cover member may, but need not, be provided with additional structure, such as a wall, inward contour, or other such protrusion, for obstructing movement of a manually operable instrument, such as an electrical switch, when the cover member is in the lockout position. This may provide added security by preventing the instrument, which may be sensitive to movement and easily operated, from being operated if the lockout device enclosure is bumped, impacted or tampered with. In some embodiments of the invention, the protrusion may be shaped and positioned such that the protrusion accommodates the instrument in multiple positions while preventing movement of the instrument from the selected position to a different position. An example of such a protrusion 50 is illustrated in FIGS. 3, 4 and 7 as a series of aligned triangular teeth, which are sized and positioned to prevent position change of a toggle-type switch when the cover member 12 is in the lockout position. However, as mentioned above, many different types of protrusions may be used to adequately obstruct movement of the switch. In other applications, such as the use of a lockout device with a rotary switch or pushbutton switch, the inclusion of such a protrusion may not be necessary or desired.

While the base member, cover member, and mounting plates of the illustrated embodiment are provided in a plastic material, the components may be provided in many types of material, and may be constructed in materials of varying strength, durability, and/or corrosion resistance depending on the particular application and environment in which the lockout device is to be used. In some applications, a more durable material may be desired for enhanced resistance to tampering.

In one embodiment of the present invention, all or part of the cover member 12 of the lockout device 10 may be provided in a clear or transparent material, such as a transparent plastic material, which may provide visibility of the electrical switch and its switching position while the cover member is in the lockout position. Further, the transparent material may be tinted to provide color coding to identify the condition of the locked out switch. For example, a transparent red cover member may be used, as the color red is commonly used to identify locked out equipment. In another embodiment (not shown), the cover member may be provided with a hole or opening in the outer portion, sized and positioned to provide visibility of the switching position while restricting access to the switch.

Figure 8:
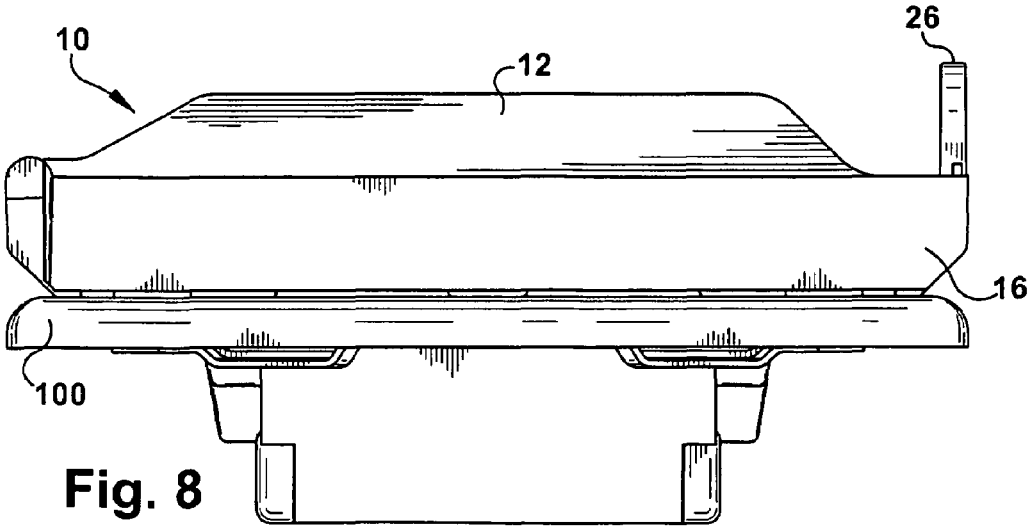
FIG. 8 is a side view of a lockout device assembled with an electrical switch face plate.

The illustrated embodiment provides additional features and benefits that offer improved convenience and adaptability. For example, the base member 16 and cover member 12 may be sized so as not to extend outward of a standard face plate 100 when installed and in the lockout position, as shown in FIG. 8. Further, the device 10 may be sized such that a standard dual switch face plate, including dual switch arrangements with two different types of electrical switches, may accommodate two devices side-by-side, to allow for lockout of adjacent switches, as shown in FIG. 7. In the arrangement of FIG. 7, first lockout device 10' may be assembled with the toggle switch 120 by installing mounting plates 46 in the first orientation and assembling the face plate screws 48 through the countersunk slots 49, and the second lockout device 10" may be assembled with the rocker switch 140 by installing mounting plates 46 in the second or inverse orientation and assembling the face plate screws 48 with the countersinks 51 in the mounting slots 52.

While several embodiments of the invention have been illustrated and described in considerable detail, the present invention is not to be considered limited to the precise constructions disclosed. Various adaptations, modifications and uses of the invention may occur to those skilled in the arts to which the invention relates. This invention is intended to cover all such adaptations, modifications and uses.

What is claimed is:

1. A lockout device for an operable instrument mounted to a structure with a set of fasteners, the lockout device comprising:

a base member comprising:

first and second side walls;

an opening disposed between the side walls for receiving the instrument when the base member is mounted to the structure;

a lock tab including an aperture for receiving a locking member; and at least one mounting plate, removably attached to the first and second side walls, the at least one mounting plate comprising a mounting feature for receiving a portion of at least one of the set of fasteners to mount the base member to the structure; and a cover member attachable to the base member and movable between a lockout position and an open position, the cover member comprising an outer portion for covering the instrument when the base member is mounted to the structure and the cover member is in the lockout position.

2. The lockout device of claim 1, wherein the lock tab extends beyond the cover member to accommodate a locking member.

3. The lockout device of claim 1, wherein when the cover member is in the lockout position, insertion of a locking member through the lock tab aperture prevents movement of the cover member from the lockout position to the open position.

4. The lockout device of claim 1, wherein the instrument is an electrical switch movable between first and second switching positions, and the cover member further comprises a protrusion extending from an inner surface of the outer portion, the protrusion being positioned to obstruct movement of the switch from the first switching position to the second switching position and from the second switching position to the first switching position when the base member is mounted to the structure and the cover member is in the lockout position.

5. The lockout device of claim 1, wherein at least a portion of the outer portion of the cover member is transparent.

6. The lockout device of claim 1, wherein the mounting feature comprises at least one recessed countersink for stabilizing the corresponding portion of the at least one of the set of fasteners when the base member is mounted to the structure.

7. The lockout device of claim 1, wherein the at least one mounting plate further comprises at least one retaining finger for retaining a spare fastener.

8. The lockout device of claim 1, wherein the lock tab comprises at least one flexible detent adapted to engage a mating edge of the cover member to provide a snap fit engagement between the lock tab and the cover member in the lockout position.

9. The lockout device of claim 1, wherein the cover member is pivotally connected to the base member at a hinge portion.

10. The lockout device of claim 1, wherein the at least one mounting plate includes first and second slots adapted to engage first and second rails on the first and second side walls to slideably attach the at least one mounting plate to the side walls.

11. The lockout device of claim 10, wherein one of the first and second slots and the first and second rails comprises a flexible detent adapted to engage a corresponding notch in the other of the first and second slots and the first and second rails to provide a snap fit engagement between the at least one mounting plate and the side walls.

12. A lockout device for an operable instrument mounted to a structure with a set of fasteners, the lockout device comprising:

a base member comprising:

first and second side walls;

at least one mounting slot extending from at least one of the first and second side walls along a back surface of the base member, the at least one mounting slot being adapted to receive a corresponding portion of at least one of the set of fasteners to mount the base member to the structure;

an opening disposed between the side walls for receiving the instrument when the base member is mounted to the structure; and a lock tab including an aperture for receiving a locking member; and a cover member attachable to the base member and movable between a lockout position and an open position, the cover member comprising an outer portion for covering the instrument when the base member is mounted to the structure and the cover is in the lockout position;

wherein when the cover member is in the lockout position, insertion of a locking member through the lock tab prevents movement of the cover member from the lockout position to the open position.

13. The lockout device of claim 12, wherein the cover member covers the at least one mounting slot when the cover member is in the lockout position.

14. The lockout device of claim 12, wherein the instrument is an electrical switch movable between first and second switching positions, and the cover member further comprises a protrusion extending from an inner surface of the outer portion, the protrusion being positioned to obstruct movement of the switch from the first switching position to the second switching position and from the second switching position to the first switching position when the base member is mounted to the structure and the cover member is in the lockout position.

15. The lockout device of claim 12, wherein the cover member further comprises first and second side walls extending from the outer portion to cover corresponding first and second base member side walls when the cover member is in the lockout position.

16. The lockout device of claim 12, wherein at least a portion of the outer portion of the cover member is transparent.

17. The lockout device of claim 12, wherein the at least one mounting slot comprises a dovetail slot.

18. The lockout device of claim 12, wherein the at least one mounting slot comprises a recessed countersink for stabilizing the corresponding portion of the at least one of the set of fasteners when the base member is mounted to the structure.

19. The lockout device of claim 12, wherein the lock tab comprises at least one flexible detent adapted to engage a mating edge of the cover member to provide a snap fit engagement between the lock tab and the cover member in the lockout position.

20. The lockout device of claim 12, wherein the cover member is pivotally connected to the base member at a hinge portion.

21. A lockout device for interchangeable use with either one of a first type electrical switch on a first face plate mounted to a wall with a first set of fasteners and a second type electrical switch on a second face plate mounted to a wall with a second set of fasteners, each of the first and second electrical switches being movable between first and second switching positions, the lockout device comprising:

a base member comprising:

first and second side walls;

an opening disposed between the side walls for receiving the switch when the base member is affixed to the face plate;

a lock tab including an aperture for receiving a locking member;

a first set of mounting features for receiving corresponding portions of the first set of fasteners to affix the base member to the first face plate; and a second set of mounting features for receiving corresponding portions of the second set of fasteners to affix the base member to the second face plate; and a cover member attachable to the base member and movable between a lockout position and an open position, the cover member comprising an outer portion for covering the base member opening when the cover member is in the lockout position;

wherein when the base member is assembled in a first orientation to either one of the first and second face plates and the cover member is in the lockout position, the cover member covers the corresponding one of the first and second electrical switches in either one of the first and second switching positions to prevent movement of the corresponding one of the first and second electrical switches to the other of the first and second switching positions.

22. The lockout device of claim 21, wherein the cover member covers the first and second sets of mounting features when the cover member is in the lockout position.

23. The lockout device of claim 21, wherein when the cover member is in the lockout position, insertion of a locking member through the lock tab aperture prevents movement of the cover member from the lockout position to the open position.

24. The lockout device of claim 21, wherein the cover member further comprises a protrusion extending from an inner surface of the outer portion, the protrusion being positioned to obstruct movement of the switch from the first switching position to the second switching position and from the second switching position to the first switching position when the base member is mounted to the face plate and the cover member is in the lockout position.

25. The lockout device of claim 21, wherein the first type of electrical switch is a toggle type switch and the second type of electrical switch is a rocker type switch.

26. The lockout device of claim 21, wherein the base member further comprises at least one mounting plate removably attached to the first and second side walls, the at least one mounting plate defining at least one mounting feature of the first and second sets of mounting features.

27. The lockout device of claim 26, wherein attachment of the at least one mounting plate to the side walls in a first orientation accommodates assembly of the base member with the first type of electrical switch, and wherein attachment of the at least one mounting plate to the side walls in a second orientation accommodates assembly of the base member with the second type of electrical switch.

28. The lockout device of claim 26, wherein the at least one mounting plate includes first and second slots adapted to engage first and second rails on the first and second side walls to slideably attach the at least one mounting plate to the side walls.

29. The lockout device of claim 28, wherein one of the first and second slots and the first and second rails comprises a flexible detent adapted to engage a corresponding notch in the other of the first and second slots and the first and second rails to provide a snap fit engagement between the at least one mounting plate and the side walls.

30. The lockout device of claim 21, wherein the first set of mounting features comprises at least one mounting slot extending from at least one of the first and second side walls along a back surface of the base member.

31. A switch lockout assembly comprising:

a) a wall mounted face plate;

b) a first type electrical switch and a second type electrical switch, each switch movable between first and second switching positions and mounted to the face plate by a set of fasteners in an adjacent position to each other;

c) two lockout devices, each device comprising:

i) a base member having first and second side walls, an opening disposed between the side walls for receiving one of the two electrical switches when the base member is mounted to the face plate, a lock tab including an aperture for receiving a locking member, and two mounting plates removably attached to the first and second side walls, the two mounting plates each comprising a mounting feature for receiving a portion of at least one of the set of fasteners to mount the base member to the face plate; and ii) a cover member attachable to an end of the base member and movable between a lockout position and an open position, the cover member comprising an outer portion for covering the one of the two electrical switches when the base member is mounted to the face plate and the cover member is in the lockout position.

32. The lockout device of claim 31, wherein when at least one cover member is in the lockout position, insertion of a locking member through a lock tab aperture prevents movement of the at least one cover member from the lockout position to the open position.

33. The lockout device of claim 31, wherein at least one cover member is pivotally connected to at least one base member at a hinge portion.

34. The lockout device of claim 33, wherein the two lockout devices are mounted in the same orientation.

* * * * *